US006589102B2

(12) United States Patent
Wess et al.

(10) Patent No.: US 6,589,102 B2
(45) Date of Patent: Jul. 8, 2003

(54) SURFACE POLISHING METHOD AND APPARATUS

(75) Inventors: Colin H. Wess, Seattle, WA (US); Erik A. Larsen, Seattle, WA (US)

(73) Assignee: Larsen Equipment Design, Inc., Seattle, WA (US)

( * ) Notice: Subject to any disclaimer, the term of this patent is extended or adjusted under 35 U.S.C. 154(b) by 0 days.

(21) Appl. No.: 09/774,225

(22) Filed: Jan. 30, 2001

(65) Prior Publication Data

US 2002/0102925 A1 Aug. 1, 2002

(51) Int. Cl.[7] ..... B24B 1/00

(52) U.S. Cl. ..... 451/42; 451/168; 451/296; 451/304; 451/309

(58) Field of Search ..... 451/42, 168, 296, 451/495, 513, 390, 388, 303, 304, 309

(56) References Cited

U.S. PATENT DOCUMENTS 3,971,170 A * 7/1976 Coburn et al. ..... 451/388
4,458,454 A * 7/1984 Barnett ..... 451/42
4,831,789 A * 5/1989 Herbin et al. ..... 451/390
5,205,083 A * 4/1993 Pettibone ..... 451/42
5,345,725 A * 9/1994 Anthony ..... 451/390
5,482,495 A * 1/1996 Mayahara et al. ..... 451/5
5,593,340 A * 1/1997 Nelson et al. ..... 451/42
5,669,804 A * 9/1997 Takahashi et al. ..... 451/59
5,695,393 A * 12/1997 Granziera ..... 451/390
5,762,546 A * 6/1998 James et al. ..... 451/504
6,036,313 A * 3/2000 Benjamin et al. ..... 351/159
6,110,017 A * 8/2000 Savoie et al. ..... 451/42
6,123,610 A * 9/2000 Larsen ..... 451/285
6,126,520 A * 10/2000 Jochim-Schmidt et al. ... 451/42
6,179,689 B1 * 1/2001 Ohno et al. ..... 451/41

* cited by examiner

*Primary Examiner*—George Nguyen
(74) *Attorney, Agent, or Firm*—Delbert J. Barnard

(57) ABSTRACT

A lens (L) with an aspheric surface (10) is held by a vacuum lens holder (12). A lap wall (42) is moved towards the lens surface (10) while in a plastic state. A polishing fabric (PF) is positioned between the lens surface (10) and the lap wall (42) before they are moved together. Fluid pressure in a chamber (44) behind the lap wall (42) is used to move the lap wall (42) and the polishing fabric (PF) against the lens surface (10). This causes the lap wall (42) to take a shape corresponding to the shape of the lens surface (10). Then, the lap wall material (42) is caused or allowed to become a solid. When the lap wall (42) is solid, the polishing fabric (PF) is caused to move relative to the lens (L) and the lap (32). The lap wall (42) holds the polishing fabric (PF) against the lens surface (10) while the polishing fabric (PF) moves across the lens surface (10) and polishes it.

34 Claims, 12 Drawing Sheets

FIG. 5
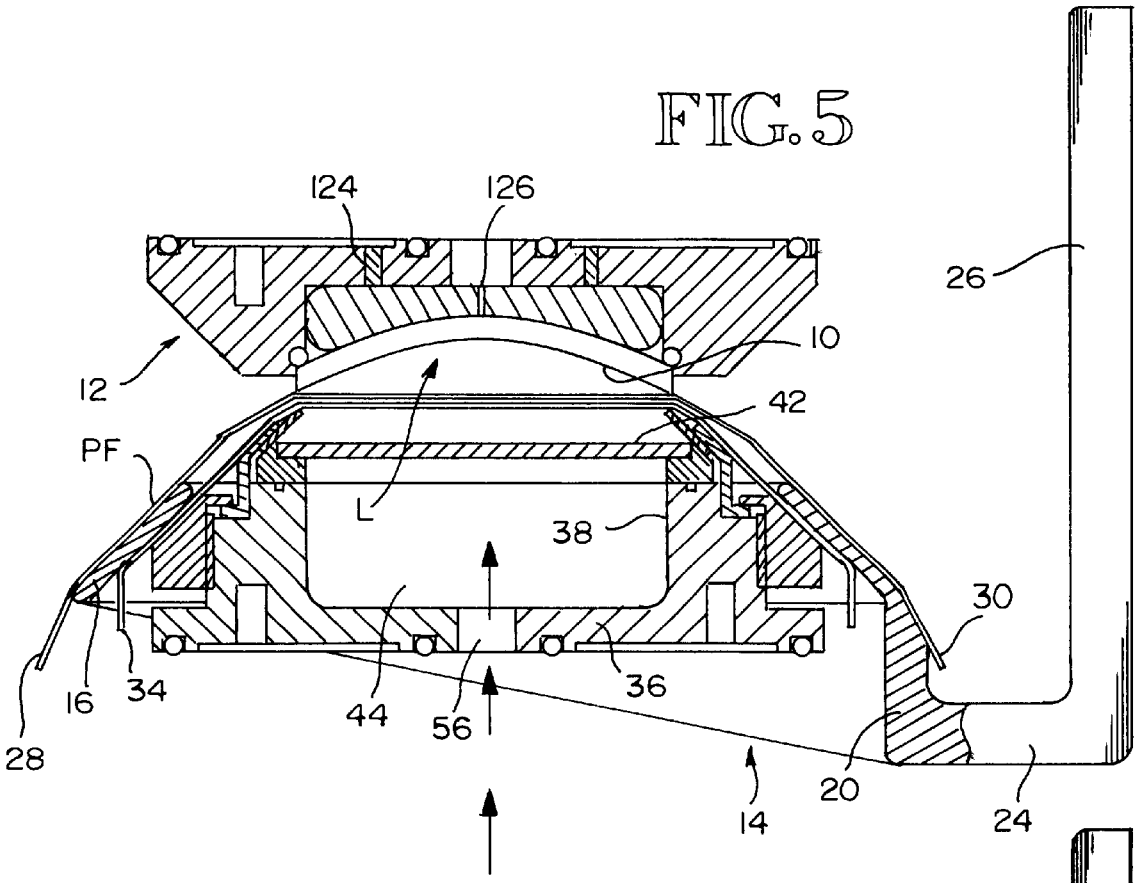
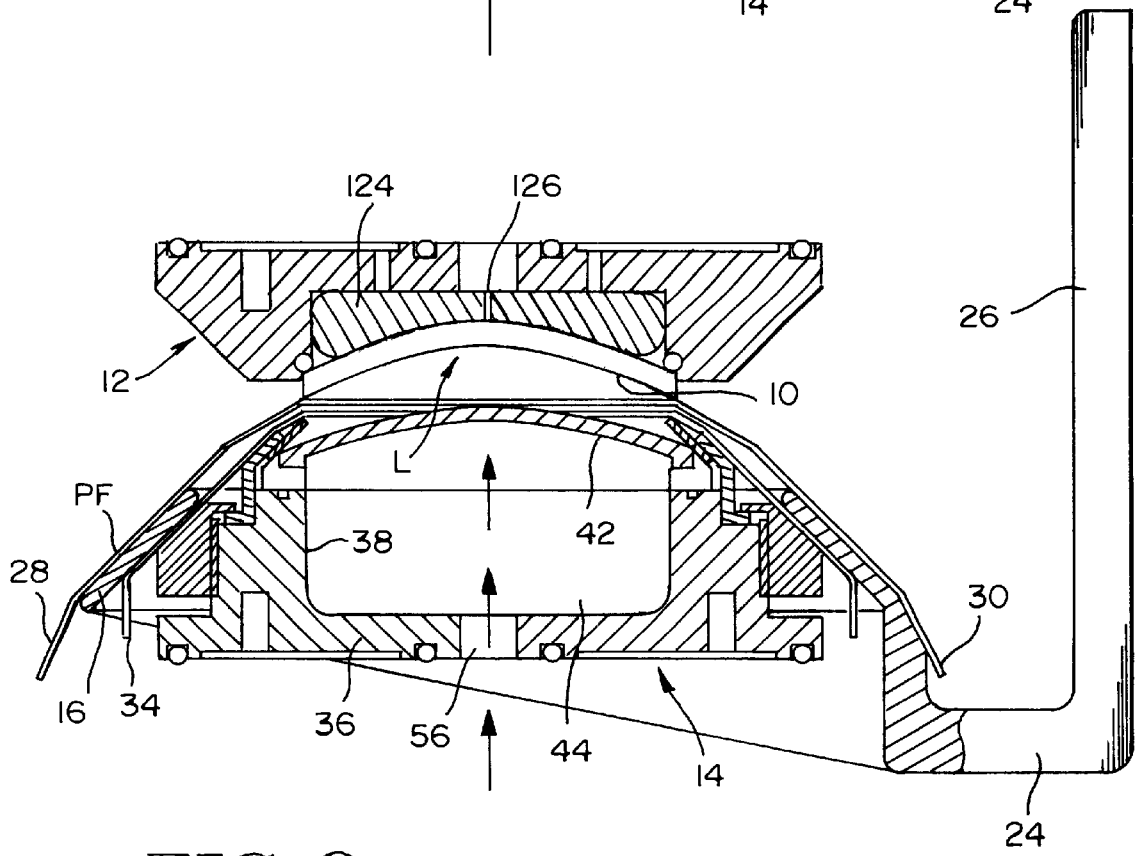
FIG. 6

FIG. 12
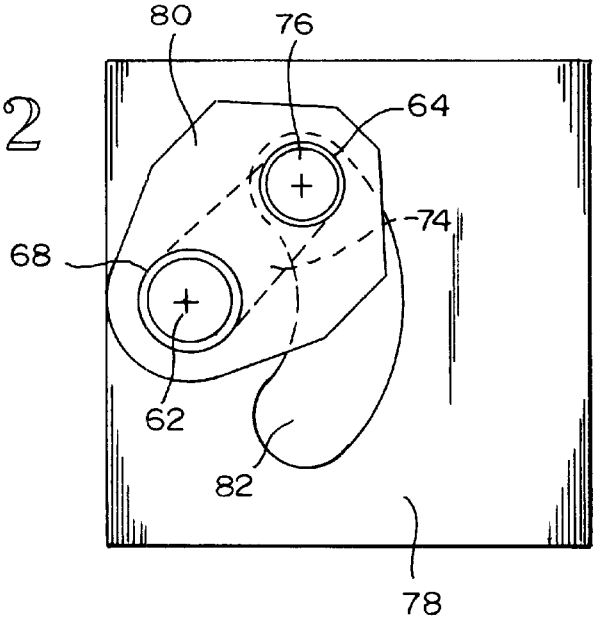
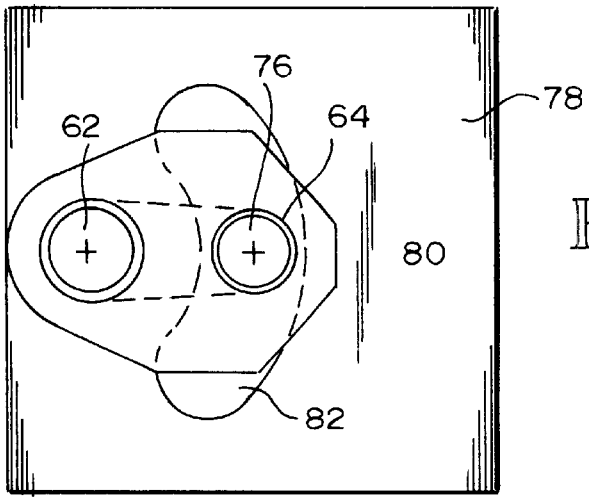
FIG. 13
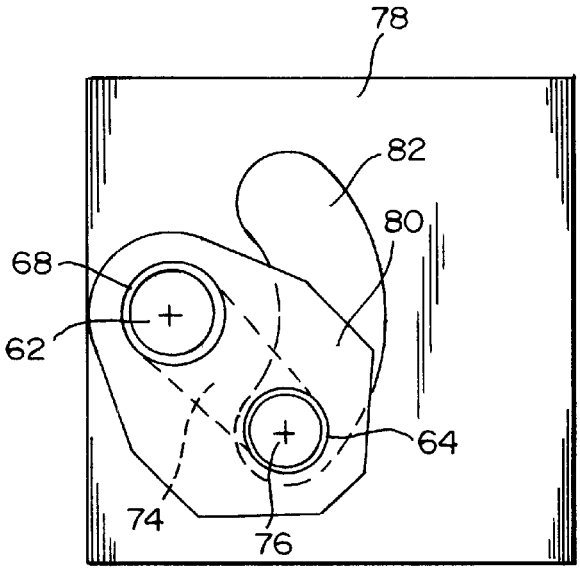
FIG. 14

FIG. 15
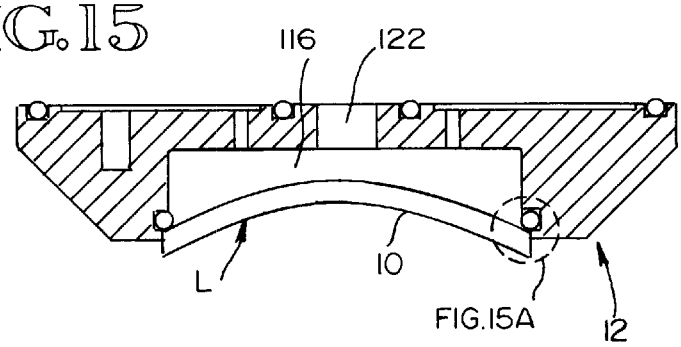
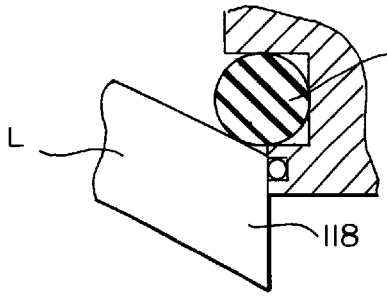
FIG. 15A
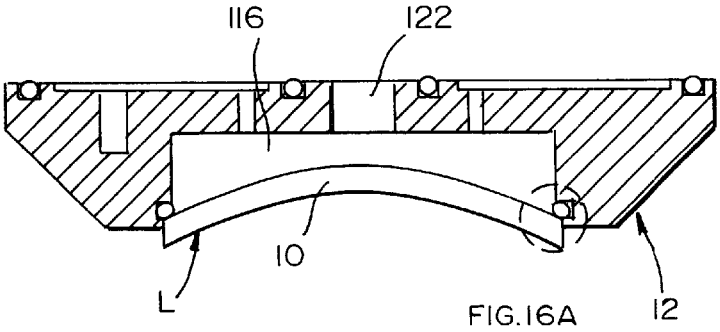
FIG. 16
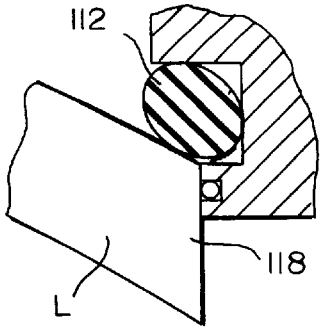
FIG. 16A
FIG. 17
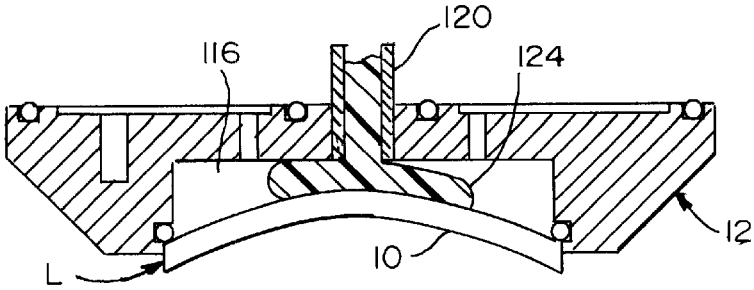

FIG. 18
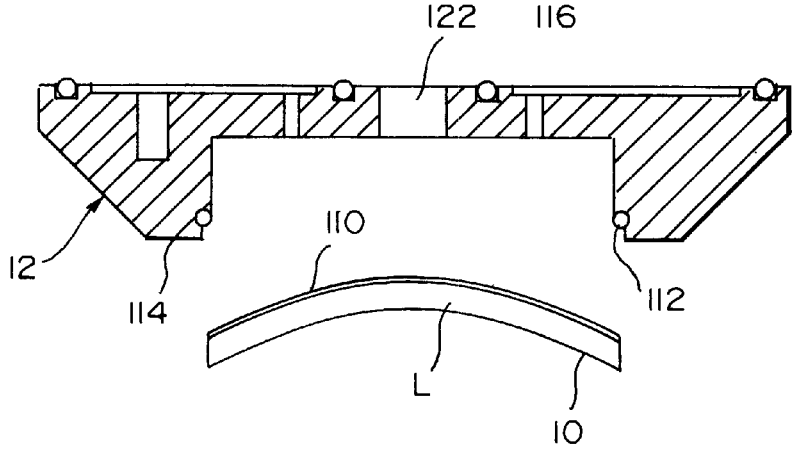
FIG. 19
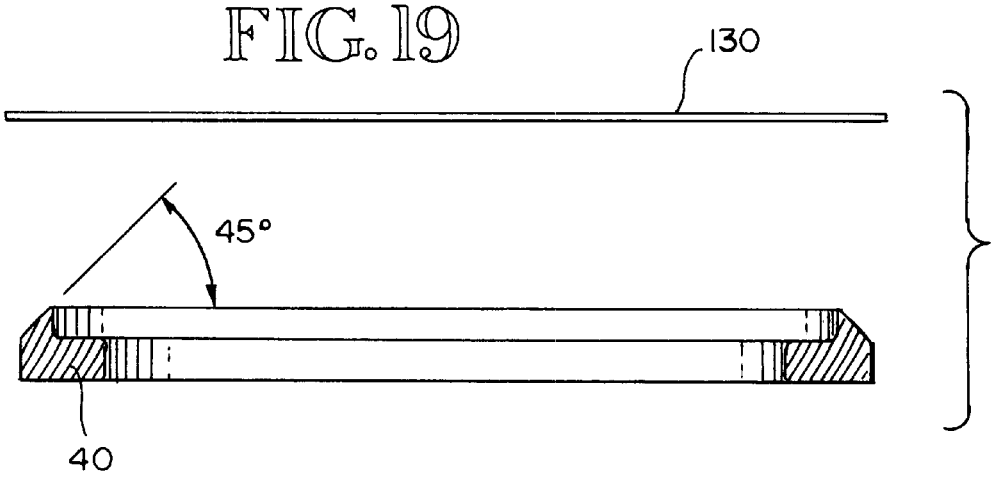
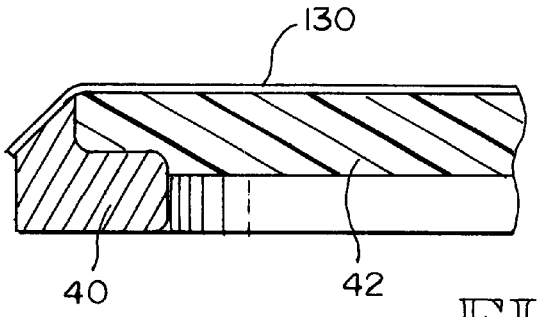
FIG. 20

SURFACE POLISHING METHOD AND APPARATUS

TECHNICAL FIELD

This invention relates to polishing curved surfaces. More particularly, it relates to the provision of a method and apparatus for polishing aspherical surfaces on optic lenses and the like.

BACKGROUND OF THE INVENTION

Conventional methods of manufacturing progressive lenses requires the lens finisher to carry an inventory of semi-finished lens blanks consisting of a range of up to ten different front curves. Each curve group is divided into add powers ranging from +1 to +3 diopters in 0.25 diopter increments. The add power of each lens is positioned off center and so there must be semi-finished lens blanks for each eye. The cost of obtaining and maintaining the necessary inventory is substantial.

The finishing operation commences with the finisher selecting a pair of lens blanks with an appropriate base curve. Then, a spherical or toric surface is formed on the back surfaces of the lens blanks. These surfaces are then polished by use of equipment that requires a substantial inventory of laps including a spherical or toric polishing lap for each back surface curve. Alternatively, a polishing lap must be cut for each lens.

In order to lessen the inventory of polishing tools, several compromises are made in the manufacture of lenses in the manner described. Firstly, the lens finisher maintains an inventory of tools for only some of the lens shapes. The prescription for a particular lens is used to match the lens base curve with the closest available tool in inventory. The finisher tries to produce a lens that is as close as possible to the prescribed lens. The exact curve necessary to produce the prescribed power is seldom cut due to this compromise.

Compromises are also made in the production of toric lenses. Typically, back surface generation of a toric surface will produce an elliptical error of one meridian. A progressive, semi-finished lens, which has two different power curves, will have a toric surface including a single cylinder amount cut on the back rather than an appropriate cylinder amount for the distance and add portions.

Aspheric back surfaces on lenses can reduce spherical aberration errors on higher power lenses. They can also reduce edge thickness on high minus lenses and reduce center thickness on high plus lenses. Most of the common current methods of lens manufacture cannot economically produce a controlled aspheric back surface.

There is a need for a method and apparatus for economically polishing a large number of different curvature lens surfaces, particularly aspheric surfaces, by use of a small inventory of tools. There is also a need for a polishing method and apparatus that will permit the lens finisher to accurately mill a semi-finished lens blank, in order to provide a lens surface that closely conforms to the prescription, followed by accurate polishing of the milled surface.

The polishing methods in use today employ abrasive slurries. A first slurry contains coarse particles. A second slurry includes fine particles. This method is messy. Also, the coarse particles, used first, contaminate the equipment making it necessary to use two polishing machines, one with the more coarse particle slurry and the other with the finer particle slurry. There is a need for a polishing system which eliminates the mess and contamination of the slurry system and allows the use of a single machine for both coarse and fine polishing. There is also a need for such a system that will provide for a quick and automatic change between different grades of abrasive material.

There is also a need for a holder for a lens or other objects with a surface to be polished, that will permit an easy and firm connection of the object to the support prior to use, and a quick and easy removal of the object from the support after polishing. There is also a need for a lap having a lap wall that is adjustable in shape and curvature and will then hold the shape and curvature.

A principal object of the present invention is to provide a method and apparatus that fills all of the needs discussed above.

Prior art methods and apparatuses for polishing lens surfaces, including aspheric surfaces, existing in the patent literature, are disclosed by the following United States patents: U.S. Pat. No. 3,050,909, granted Aug. 28, 1962 to George O. Rawstron; U.S. Pat. No. 4,606,151, granted Aug. 19, 1986, to Erich Heynacher; U.S. Pat. No. 4,850,152, granted Jul. 25, 1989, to Erich Heynacher, Klaus Beckstette and Michael Schmidt; U.S. Pat. No. 4,979,337, granted Dec. 25, 1990, to Arthur G. Duppstabt; U.S. Pat. No. 4,980,993, granted Jan. 1, 1991, to Hideaki Umezaki; U.S. Pat. No. 5,095,660, granted Mar. 17, 1992, to Lawrence A. Dillon; U.S. Pat. No. 5,255,474, granted Oct. 26, 1993, to Tomohiro Gawa, Katsuyoshi Shingu and Kiyoshi Mayahara; U.S. Pat. No. 5,577,950, granted Nov. 25, 1996, to Kenneth L. Smith and Stephen Kulan; U.S. Pat. No. 5,593,340, granted Jan. 14, 1997, to Thomas E. Nelson and Erik A. Larsen; U.S. Pat. No. 5,632,668, granted May 27, 1997, to Gene O. Lindholm and Robert A. Follensbee; U.S. Pat. No. 5,762,546, granted Jun. 9, 1998, to Michael D. James and Fritz R. Kruis and U.S. Pat. No. 6,123,610, granted Sep. 26, 2000, to Erik A. Larsen. These patents should be carefully considered for the purpose of putting the present invention into proper prospective with the prior art.

BRIEF SUMMARY OF THE INVENTION

The present invention includes the provision of a lens polishing system in which a polishing fabric is positioned between a surface to be polished and a lap wall having a shape complementary to the shape of the surface to be polished. The surface to be polished and the lap are held in fixed rotation position relative to each other. The polishing fabric is slide back and forth between them, across the surface to be polished, and the surface to be polished and the lap are rotating together relative to the polishing fabric. The present invention also relates to the components of the system, and to assemblies of the components.

The present invention includes providing a lap that includes a lap wall that is constructed from a material having a plastic first state and a substantially solid second state. When it is in its first state, the lap wall is formable to the curvature of the surface to be polished. It is moved relatively against the surface to be polished, causing it to assume a shape that is complementary in form and matching in shape to the shape of the surface to be polished. Once reshaped, the lap wall material is caused to assume its substantially solid second state in which it will retain the shape placed on it by the surface to be polished.

In one embodiment of the invention, the surface to be polished is a surface on a lens. A lens holder is provided and the lens is secured to the holder with the surface to be polished directed away from the holder. The present invention includes providing a vacuum lens holder adapted to hold the lens or other member in place on the holder.

The present invention includes providing a lap that comprises a rigid mounting ring and a lap wall within the confines of the mounting ring. The lap wall material is initially plastic and is moldable. While in a plastic state, the wall is pressed against a surface that is to be polished causing it to conform in shape to the surface to be polished. The lap wall is then caused to become substantially solid.

In a system of the invention, the surface to be polished is on a member that is secured to a support that is in turn secured to a frame. The lap wall is secured to a support that in turn is also secured to the frame. The frame is used to hold the surface to be polished and the lap wall in fixed positions, each to the other. A polishing fabric is positioned between the surface to be polished and the lap wall. The lap wall is positioned to hold the polishing fabric into contact with the surface to be polished. Then the polishing fabric is moved relatively across the surface to be polished and/or the surface to be polished is moved relatively across the polishing fabric. The polishing fabric acts to polish the surface to be polished while the lap guides movement of the polishing fabric across the surface to be polished.

The present invention also includes providing a support and guide frame for the polishing fabric that is positioned axially between the support for the member having a surface to be polished and the support for the lap. This frame has a peripheral portion that surrounds an open center. The polishing fabric sits on the peripheral portion and slides relative to the peripheral portion while staying in contact with it.

The present invention includes an embodiment in which the polishing fabric is in the form of a flexible and preferably elastic belt that rests on the support and guide frame and is connected to the drum. The drum is rocked about an axis, causing the polishing fabric to move sideways across the support and guide frame, first in one direction and then in the opposite direction. The drum is suitably rotated in one direction about its axis. It is then stopped and then rotated back in the opposite direction, so as to cause a back and forth movement of the polishing fabric over the support and guide frame and across the surface to be polished.

The present invention also includes providing a system in which the holder for the member having a surface to be polished. The lap, and the support and guide frame for the polishing fabric, are all mounted on a turntable so as to be movable back and forth about an axis in a way that causes the surface to be polished and the lap wall to rotate together around a common axis. The surface to be polished is in contact with the polishing fabric and the lap maintains the polishing fabric pressed substantially against the surface to be polished.

The present invention includes providing a polishing fabric composed of a flexible and preferably elastic fabric base and particles of an abrasive material that are bonded to a fabric base. In preferred form, the fabric base regions for particles that differ in coarseness, from coarse to fine. The polishing fabric lacks the messiness of a slurry. Also, the use of a fabric with plural regions of abrasive material makes it possible to perform the entire polishing operation by use of a single machine.

The present invention includes providing a vacuum holder for a lens or other member having a surface to be polished in which a backing is cast in situ behind a member having the desired rear surface shape of a member that is to be held by the holder and which becomes firm so that it possesses a front surface that conforms to such shape and curvature. The invention further includes providing a method of making the vacuum holder.

The present invention further includes providing a lap comprising a frame member that includes a socket, a support ring for a lap wall that is removably securable to the frame member, about the socket, and a lap wall that spans across the support ring and has a periphery that is connected to the support ring. The lap wall is constructed from a material that has a plastic state and a solid state. Fluid pressure is introduced into the socket, behind the lap wall, when the lap wall material in is its plastic state. The fluid pressure is used to force the plastic material outwardly against a surface on a member that has been provided outwardly of the lap wall, so that the lap wall will take on the shape and curvature of such surface. Then the lap wall material is caused to change from its plastic state to its solid state so that it will retain its form and surface shape and curvature.

These and other advantages, objects and features will become apparent from the following best mode description, the accompanying drawings, and the claims, all of which are incorporated herein as a part of the disclosure of the invention.

BRIEF DESCRIPTION OF THE SEVERAL VIEWS OF THE DRAWING

Like reference numerals and letters refer to like parts throughout the several views of the drawing, and:

FIG. 5 is a view like FIG. 3 but showing the vacuum lens holder and lens moved downwardly and including arrows identifying the path of fluid pressure delivery into the lap;

FIG. 6 is a view like FIG. 5 but showing air pressure in a chamber below the lap, and moving a lap wall, and the wear member and the polishing fabric, upwardly towards a lower surface of the lens;

FIG. 12 is a cross sectional view taken substantially along lines 12, 13, 14—12, 13, 14 of FIG. 11, and showing the lens holder and the lap in a first rotational position relative to a frame member;

FIG. 13 is a view like FIG. 12 but showing the lens holder and lap in a second rotational position relative to the frame member;

FIG. 14 is a view like FIGS. 12 and 13, but showing the lens holder and lap in a third rotational position relative to the frame member;

FIG. 15 is an enlarged scale axial sectional view through the lens holder, showing a lens being moved into the lens holder, and including a larger scale detail view showing an O-ring that is positioned between the lens and the lens holder;

FIG. 16 is a view like FIG. 15 but showing the lens moved further into the lens holder and showing the O-ring compressed;

FIG. 17 is a view like FIGS. 15 and 16, minus the lens edge detail, and on a smaller scale, such view showing epoxy being injected into a cavity in the lens holder above the lens;

FIG. 18 is a view like FIG. 17, but showing the lens spaced from the lens holder and showing a protective film on the upper surface of the lens;

FIG. 19 is an exploded view showing a support ring for the lap wall in axial section and showing a fabric cover in side elevation; and FIG. 20 is a fragmentary sectional view showing the lap material on the support ring and the sheet of fabric covering the ring and the lap material.

DETAILED DESCRIPTION OF THE INVENTION

Figure 1:
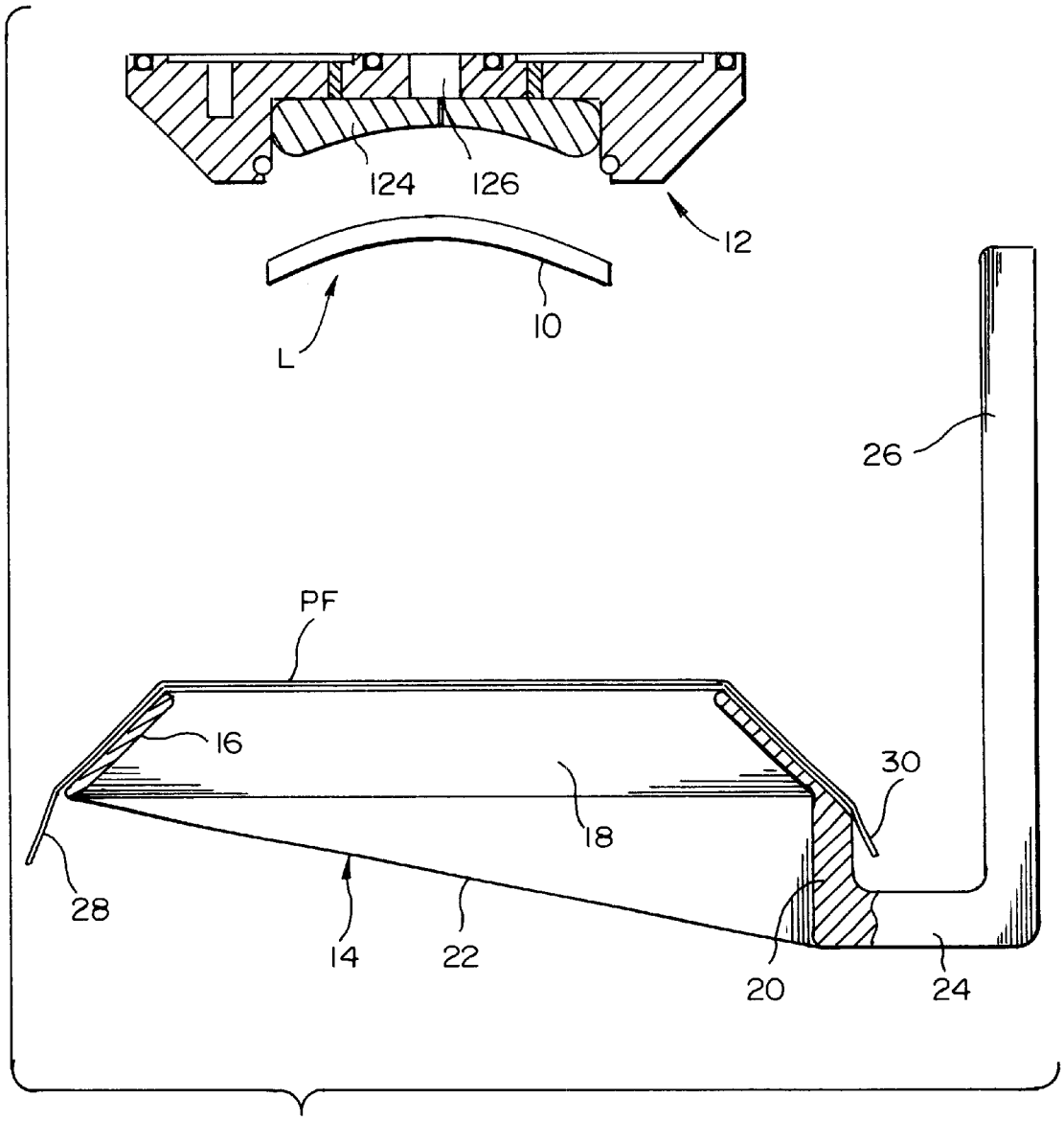
FIG. 1 is a fragmentary, exploded elevational view, showing a lens to be polished spaced from a vacuum lens holder and positioned between the holder and a polishing fabric support and guide ring.

FIG. 1 shows a concave/convex lens L, with its concave back side 10 directed downwardly. Lens L is shown spaced below a lens holder 12 that is hereinafter described in some detail. FIG. 1 also shows a portion of a polishing fabric PF on a support and guide frame 14. Frame 14 includes a peripheral wall portion 16 surrounding an open center 18. Wall portion 16 may be a ring that is frusto conical in shape. Ring 16 is shown to be above a base 20 that is a frustum of a cylinder having a diagonal lower boundary 22. Base portion 20 is connected to a short horizontal arm 24 that in turn is connected to a relatively long vertical arm 26. Arms 24, 26 mount the support and guide frame 14 onto a supporting member in a manner that is hereinafter described with reference to some of the other figures of the drawing. In FIG. 1, the polishing fabric PF is shown positioned on the support and guide frame 14, with opposite side portions 28, 30 falling off on opposite sides of the member 14.

Figure 2:
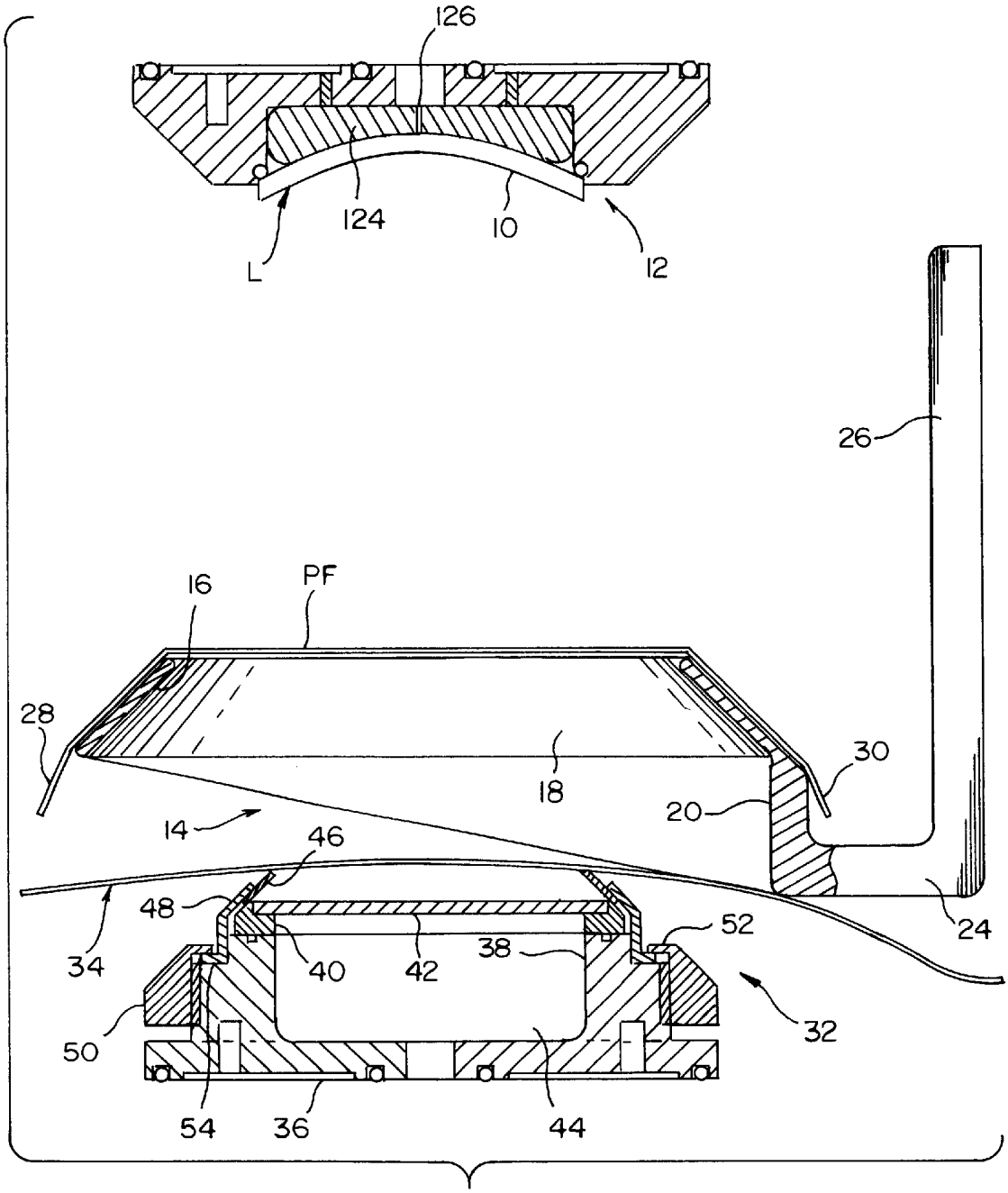
FIG. 2 is a view like FIG. 1 but showing the lens attached to the vacuum lens holder, and showing a lap positioned below the polishing fabric support and guide ring, and further showing a wear member positioned between the lap and the polishing fabric support and guide ring.

FIG. 2 is like FIG. 1 but further showing a lap assembly 32 (hereinafter simply "lap") positioned below the support and guide frame 14, and further showing a wear member 34 extending over the top of the lap 32. Lap 32 has a circular base 36, a cylindrical sidewall 38 extending upwardly from the base 36, a lap wall support ring 40 and a lap wall 42. The ring 40 and the lap wall 42 are supported on the cylindrical portion 38 of the lap base 36, 38, in a manner providing a fluid chamber 44 below the lap wall 42. A frusto conical wall 46 sets down on the ring 40. A first retainer wall 48 surrounds the ring 46 and sets down on the cylindrical portion 38 of the base 36, 38. A second retainer ring 50 surrounds the cylindrical portion 38 of the base 36, 38 and at its top includes a lip 52 that bears down on a lip 54 forming a base of ring 38. When ring 50 is secured to the cylindrical wall portion 38, such as by use of mating threads where they come together, the lip 52 will bear down on the lip 54 causing the upper portion of ring 48 to bear down on ring 46.

Figure 3:
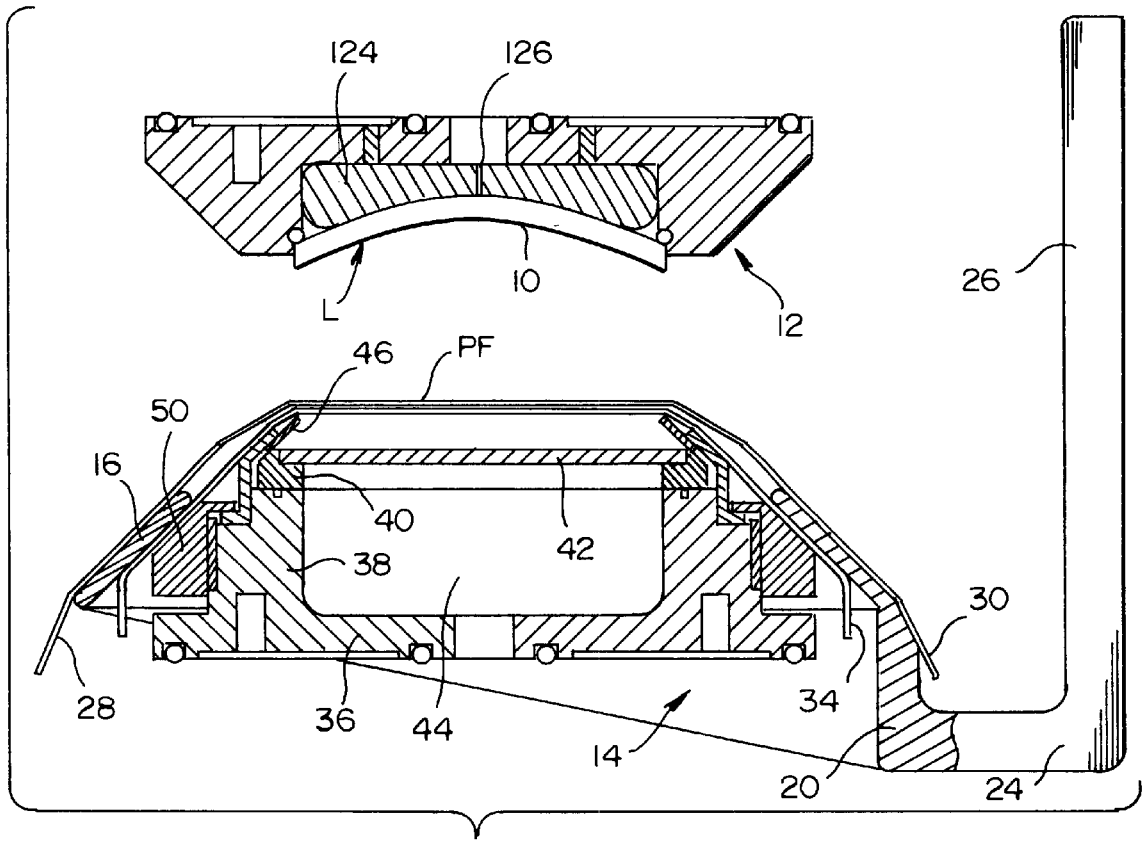
FIG. 3 is a view like FIG. 2 but showing the lap moved upwardly towards the polishing fabric support and guide ring and showing the vacuum lens holder and lens moved closer to the polishing fabric than in FIG. 2.

FIG. 3 is like FIG. 2 but shows the lap 14 moved upwardly into the ring 18. The outer perimeter portion of the wear member 34 becomes clamped between ring 50 and ring 16. The wall 46 supports the center portion of the wear member 34 in a position closely below the polishing fabric PF. In FIG. 3, the lap wall 42 has a substantially planar shape. At that time it is a two dimensional circular member.

Figure 4:
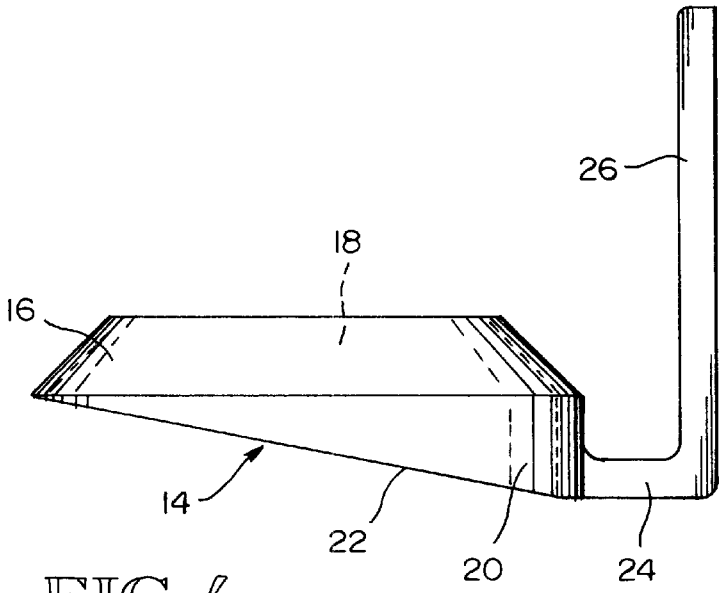
FIG. 4 is an elevational view of the polishing fabric holder and guide ring by itself.

FIG. 4 is a side elevational view of the polishing fabric support and guide member 14, and its support portions 24, 26.

Figure 7:
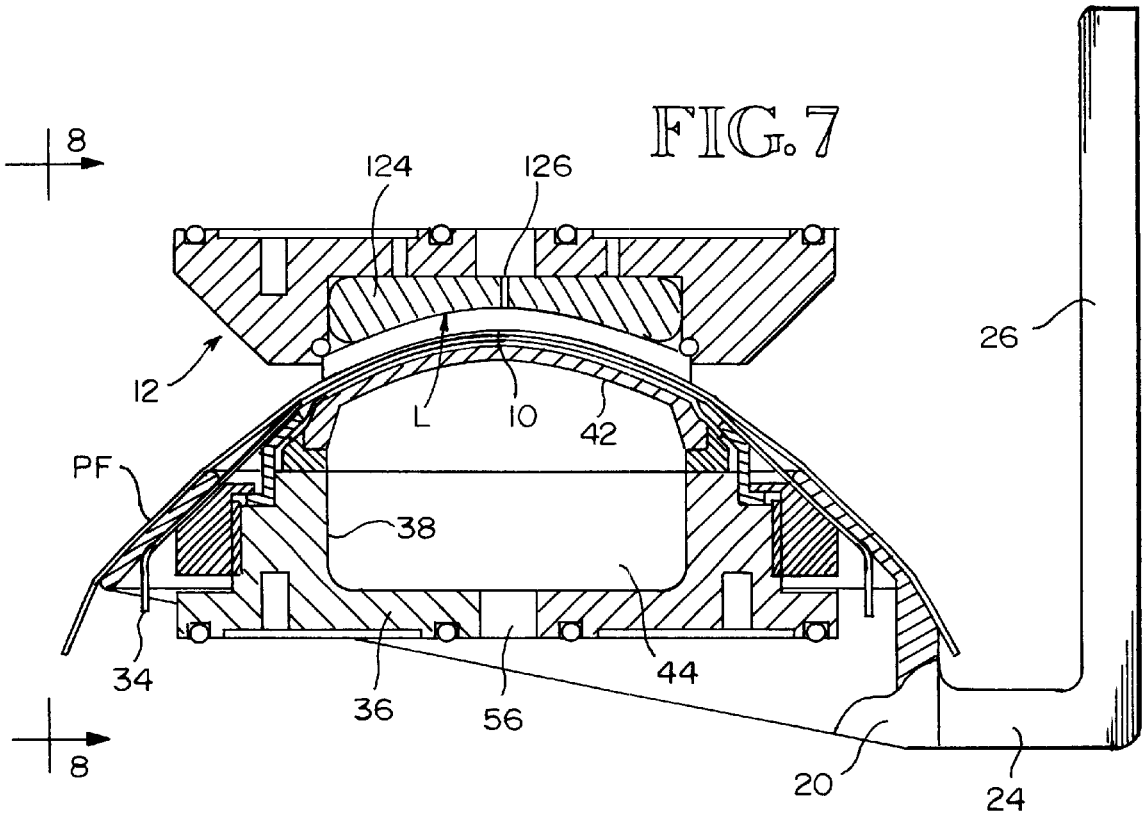
FIG. 7 is a view like FIG. 6 but showing air pressure in the chamber below the lap wall having moved the lap wall, the wear member and the polishing fabric upwardly into contact with the lower surface of the lens.

FIG. 5 is a view like FIG. 3 but shows the lens holder 12 moved downwardly so as to place the lower outer edge portion of the lens L into contact with the polishing fabric PF. In this view, the lap wall 42 is still in the form of a two dimensional circular disc. FIG. 5 shows a fluid entering chamber 44 via an inlet/outlet opening 56. At this stage, the lap wall 42 must be in a plastic state. FIG. 6 shows further fluid introduction via opening 56 into chamber 44 and shows the fluid pressure acting to move the center of the lap wall 42 upwardly against the wear member 34 and the polishing fabric PF. FIG. 7 shows fluid under pressure trapped in the chamber 44 and acting to move the lap wall 42 upwardly as far as the lens surface 10 will allow it to move. The wear member 34 and the polishing fabric PF remain on the lap wall 42, between it and the lower surface 10 on the lens L. The fluid pressure in chamber 44 urges the lap wall 42 to conform in shape to the lower surface 10 of the lens L. The lap wall 42 responds by taking on a shape complementary to the shape of the surface 10. In the example embodiment that is illustrated, the surface 10 is a concave surface. Thus, the lap wall 42 acquires a convex upper surface that substantially matches the curvature of concave surface 10. Following this shaping of the lap wall 42, the lap wall 42 is allowed or caused to assume a solid state so that it becomes a substantially rigid member that will provide a firm back up to the polishing fabric PF during polishing. The proper amount of clamping force is obtained by regulating the pressure in chamber 44.

Figure 8:
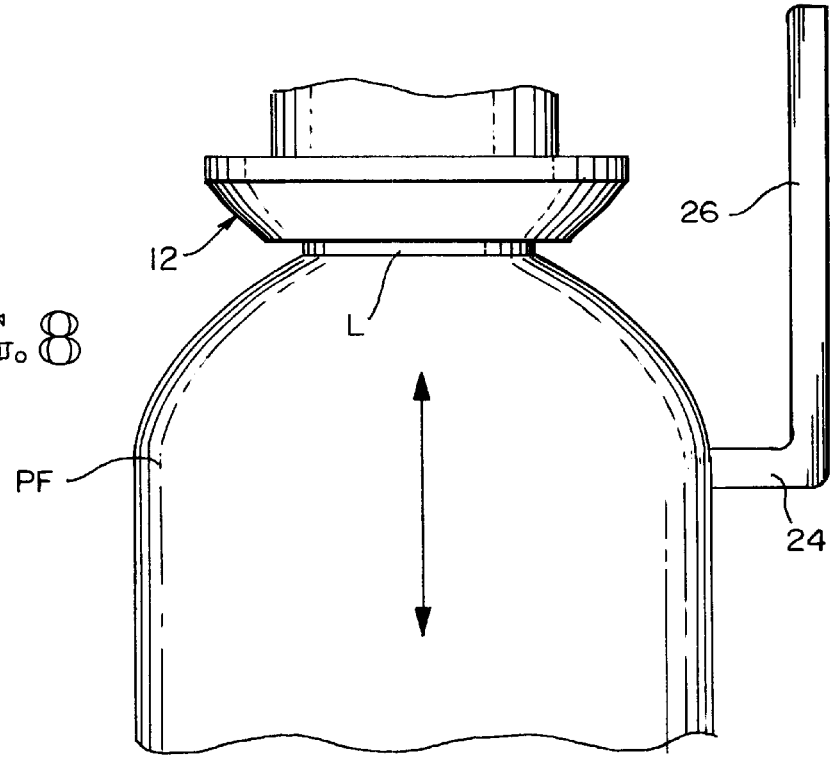
FIG. 8 is a fragmentary elevational view taken substantially along line 8—8 of FIG. 11, showing the polishing fabric moving between the lap wall and the lens.

When the parts are in the position shown by FIG. 7, the polishing fabric PF is positioned snugly between the lap wall 42 and the surface 10 but the pressure on it is not so great that the polishing fabric PF is clamped against movement. Rather, the polishing fabric PF is allowed to move and its movement is necessary to the polishing function that it performs. As the surface 10 wears away, the fluid pressure moves the lap wall 42 towards surface 10 so that it continues to push the polishing fabric PF against surface 10. FIG. 8 shows a typical width of the polishing fabric PF relative to the lens L and the lap that is below the polishing fabric PF.

Figure 9:
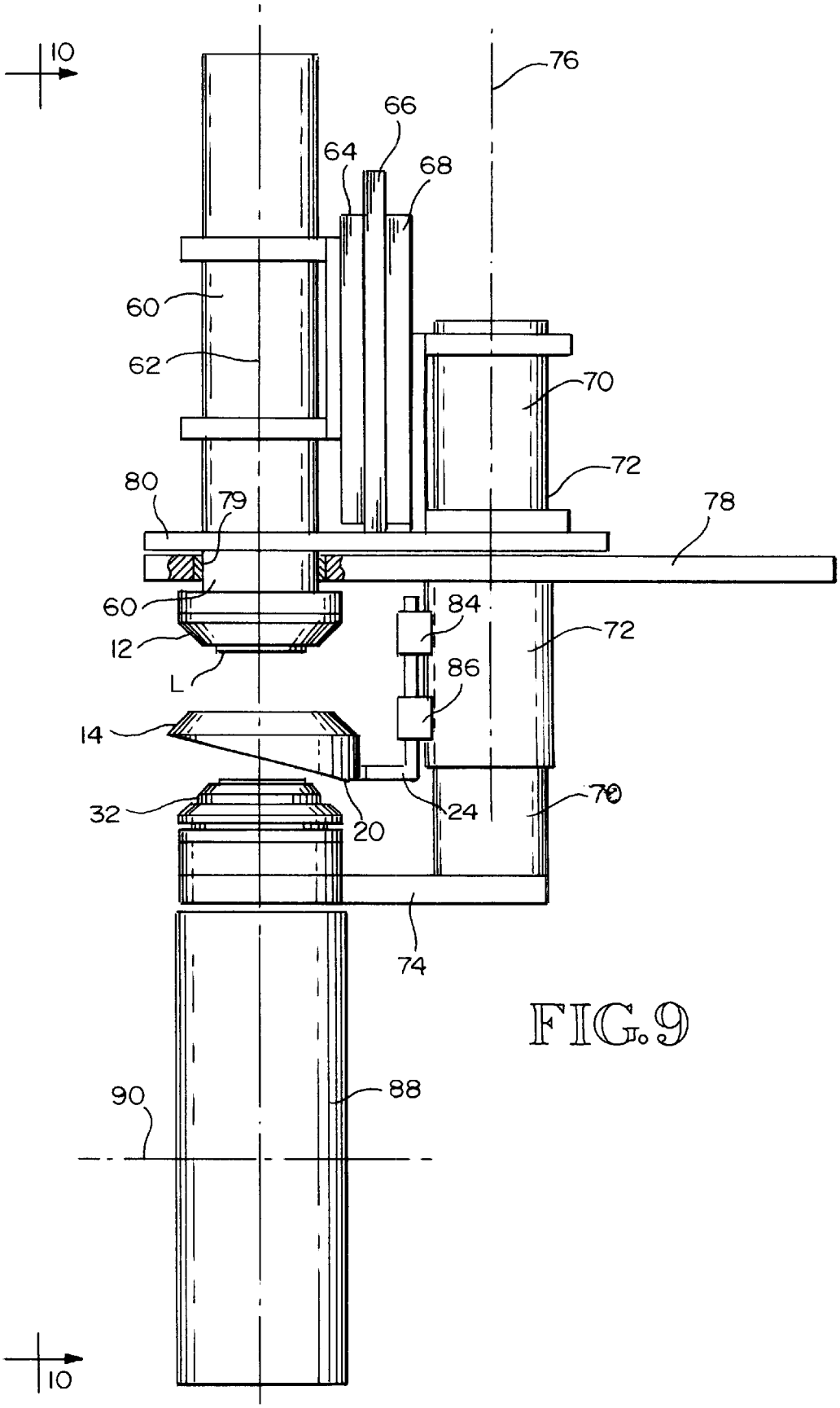
FIG. 9 is a side elevational view of a full mechanism.
Figure 10:
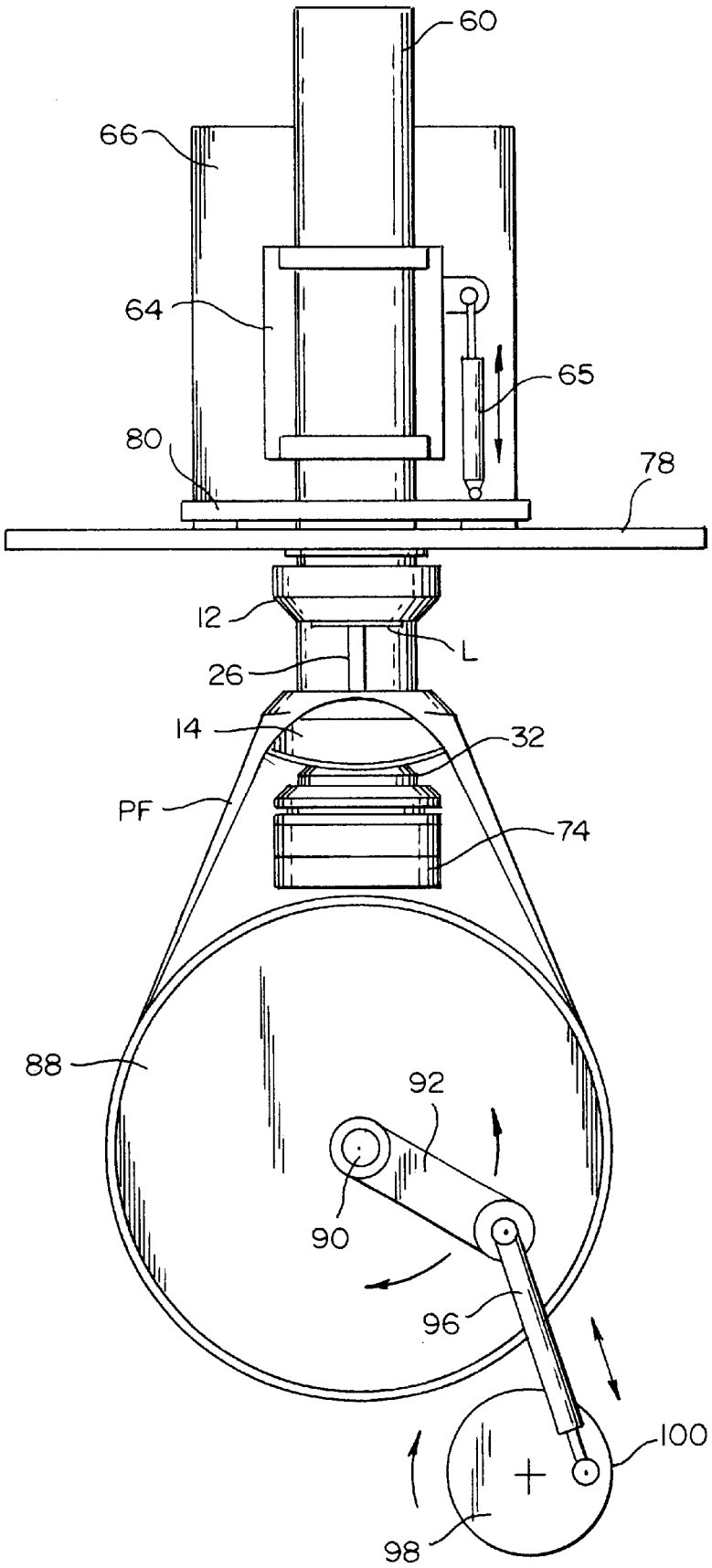
FIG. 10 is an elevational view taken substantially along line 10—10 of FIG. 9, showing the lens holder raised and the lap lowered.
Figure 10A:
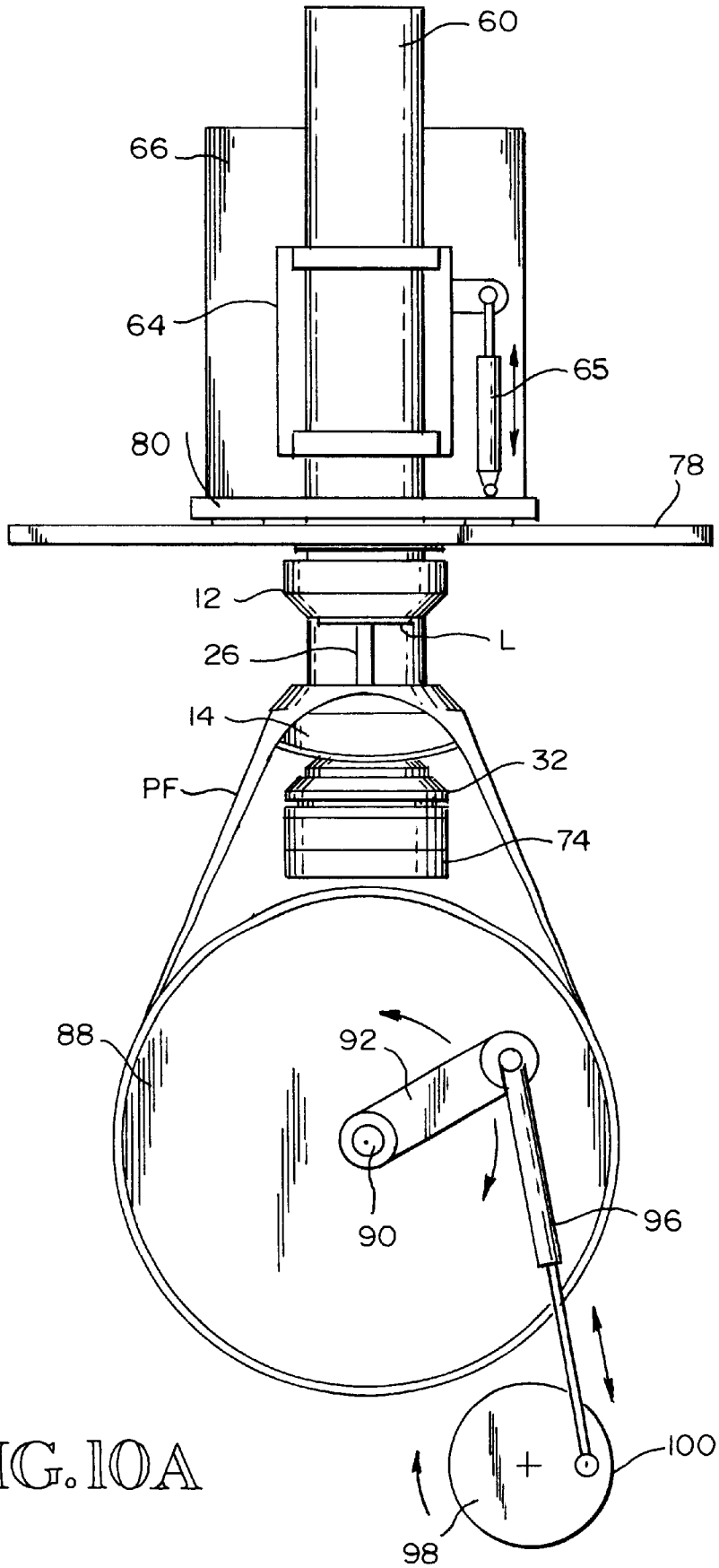
FIG. 10A is a view like FIG. 10 but showing a different region of the polishing fabric moved between the lens and the lap.
Figure 11:
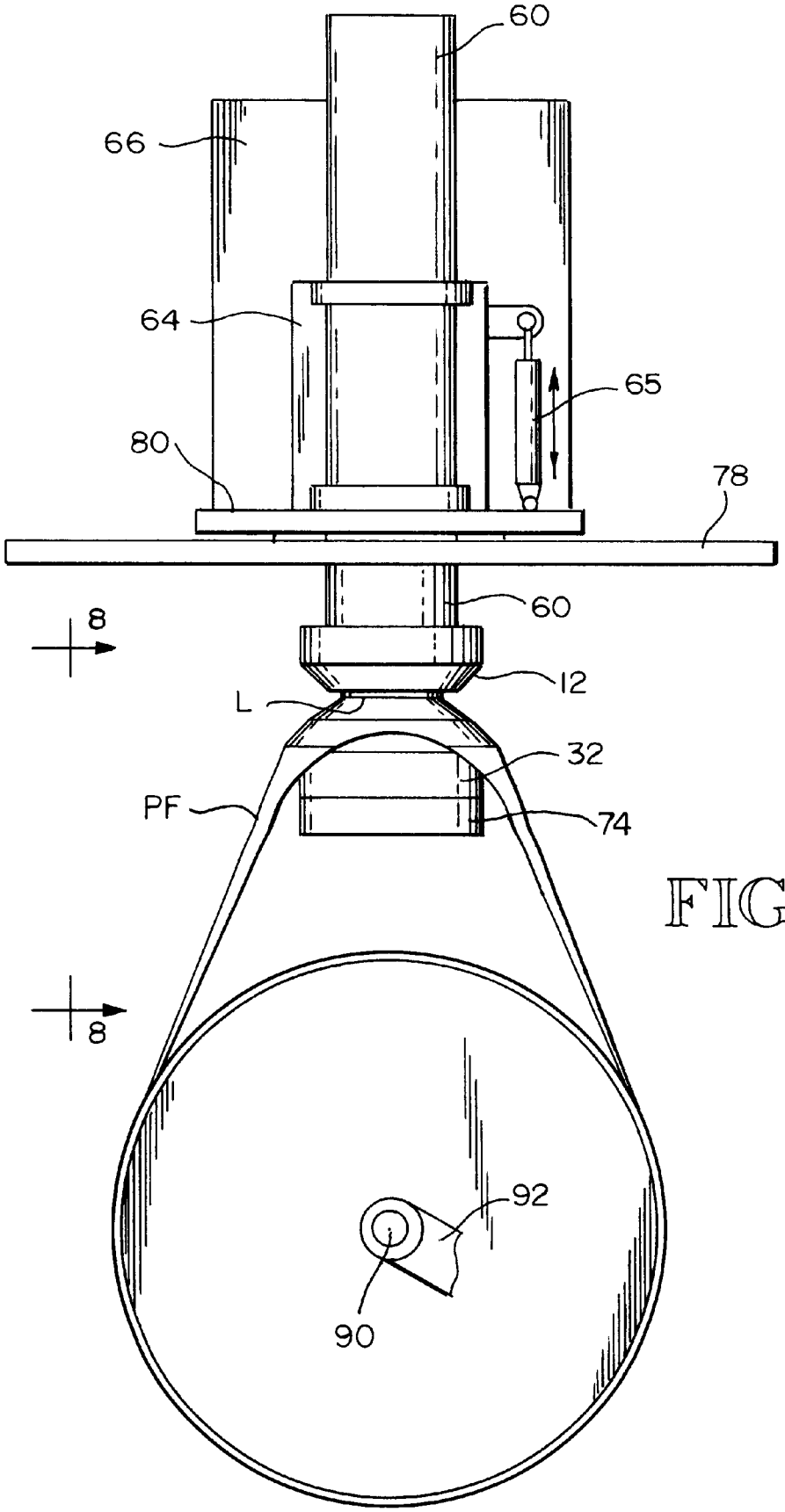
FIG. 11 is a view like FIG. 10 but showing the lens holder lowered and the lap raised.

FIGS. 9–11 are elevational views of a polishing machine that incorporates principles of the present invention. This embodiment comprises a first tubular frame member 60 having a longitudinal axis 62. Preferably, member 60 is secured to the movable component of a slide mount 64. The slide mount 64 mounts the member 60 for straight line vertical movement relative to a vertical plate 66 that is secured at its bottom to a turntable 80. A second slide mount 68 connects a second tubular member 70 for vertical movement up and down relative to the plate 66. FIGS. 9, 10 and 10A show the member 60 in a raised position. FIG. 11 shows member 60 in a lowered position. The parts 60, 64 raised and lowered by use of linear actuators 65. The lens holder 12 is secured to the lower end of member 60 and it moves up and down with member 60, relative to the platform 78 and the turntable 80. Tubular frame member 70 extends through and is movable up and down relative to a tubular member 72 that is connected at its upper end to the turntable 80. The lower end of member 70 is attached to a cross frame member 74 which supports the lap 32. Tubular member 70 includes a longitudinal axis 76. A lowering of the tube 70, by use of the slide mount 68, will lower the frame member 74 and the lap 32. A raising of the frame member 70, by use of the slide mount 68, will raise the frame member 74 and the lap 32. Slide mount 68 is moved up and down by a second actuator (not shown) like actuator 65, positioned on the opposite side of plate 66. It is connected at its lower end to turntable 80 and at its upper end to the moveable part of slide mount 68.

As shown by FIGS. 9–11, turntable 80 is mounted for rotation about axis 62 (FIGS. 12–14). Platform 78 includes an arcuate slot 82 in which the guide component 72 is situated. The turntable 80 and the member 60 are rotatable in position about the axis 62. Rotation of component 62 about axis 62 moves with it the turntable 80 and the members 70, 72 that are mounted on the turntable 80. The support arm 74 is centered with respect to the turntable 80. As shown by FIGS. 12–14, both frame members 60, 70 move together. As a result, the lap 32, the lens holder 12 and the lens L all rotate about axis 62.

Referring to FIG. 9, an opening is provided in the platform 78 and a sleeve bearing 79 is positioned within this opening. The tubular frame 60 extends through the tubular bearing 79 and is guided by it for vertical movement along the axis 62. Bearing 79 also supports the tubular frame 60 for rotation about the axis 62. A fluid cylinder (not shown) may be connected between one of the movable parts 74, 80, 64 and used for swinging the assembly back and forth along the arcuate path established by the arcuate cutout 82. Preferably, these parts are adapted for rotation through an arc of about ninety degrees.

The support arm 26 is connected to the component 79 at locations 84, 86. Thus, the polishing cloth support and guide frame 14 will swing in position together with the members 70, 72. All of these components will move along a common arcuate path in which their centerline axes remain aligned.

FIGS. 9–11 show a large drum 88 positioned below the lap 32. The vertical axis 62 intersects horizontal axis 90 which is the rotational axis of the drum 88. In at least some embodiments of the invention, the drum 88 is rocked about axis 90, first in one direction and then in the opposite direction. By way of example, and as shown by FIG. 10, a crank arm 92 may be connected at one end to the drum 88 for rotation about the axis 90. The opposite end 94 of the crank arm 92 may be pivotally connected to the upper end of a drive link 96. The lower end of the drive link 96 may be pivotally connected to a drive wheel 98 that is driven by a drive motor 100. Rotation of the drive wheel 98 by the drive 100 will cause an up and down movement of the drive arm 96 and it will in turn cause an up and down movement of the crank arm 92. An upward movement of crank arm 92 will cause a counterclockwise rotation of the drum 88, as viewed in FIG. 10. A downward rotation of the crank arm 92 will cause a clockwise movement of the drum 88.

Preferably, the drive link 96 is a linear fluid actuator, i.e. an air or oil cylinder. This makes it possible to change its length by fluid introduction and removal from the actuator 96.

FIG. 10 shows a short drive link 96. FIG. 10A shows a longer drive link 96. Changing the length of the drive link 96 shifts the polishing fabric PF in position over the support and guide ring 14. Relatively coarse polishing particles are bonded to the polishing fabric PF in one region of the fabric base and finer polishing particles are bonded to another region of the fabric base. Extension of the drive link 96 moves one of the regions up into contact with the surface to be polished. A retraction of the drive link 96 moves the other region into contact with the surface to be polished. The surface to be polished is first polished by use of the relatively abrasive region of the polishing fabric PF. Then the actuator 96 is extended or retracted to move the region of finer particles into position to finish the polishing operation. Of course, more than two regions of particle size can be provided.

There are a large number of other ways of moving the drum back and forth about an arcuate path and the invention should not be limited to any particular way. By way of further example, one end of a fluid motor could be attached to the drum 88 at a location spaced radially outwardly from the center of rotation 90. The opposite end of the fluid motor may then be attached to a fixed frame member. Extension and retraction of this fluid member would cause the drum 88 to move back and forth along the arcuate path 97. Also, the turntable 80 can be moved back and forth in a large number of ways. For example, a linear actuator can be attached at one end to the turntable 80 and at the opposite end to the platform 78, so that extension of the linear actuator will swing the turntable 80 in one direction and retraction of the linear actuator will swing it back in the opposite direction.

The polishing fabric PF is in some manner secured to the drum 88. For example, the polishing fabric PF may be in the nature of a belt that is secured to the drum 88 by a clamp structure. The polishing fabric PF may be inserted between clamp members and the drum 88 and then the clamp members can be fastened to the drum 88 so as to clamp the end portions of the polishing fabric PF between them and the drum 88.

The polishing fabric PF may comprise a fabric base constructed from any suitable fabric. The fabric base may be a tough film of synthetic material, or may be a woven fabric or cloth formed from synthetic or natural threads. A solid film fabric is preferred. Preferably, the fabric base is both flexible and elastic so that it will conform to a concave or convex surface. The polishing compound is adhered to the surface of the fabric base.

Referring to FIG. 10, clockwise rotation of the drum 88 will cause the polishing fabric PF to slide in the direction shown by the arrows 102. Rotation of the drum 88 in the opposite direction will cause a sliding movement of the polishing fabric PF in the opposite direction. Circumferential movement of the polishing fabric PF relative to the surface to be polished while at the same time rotating the surface to be polished through an arc of about ninety degrees about axis 62 will provide 360° of random movement of the polishing particles relative to the surface to be polished. The back and forth movement of the polishing fabric PF, caused by a rocking motion of the drum 88, is controllable and is most often done at a speed that approximates the speed of a polishing cloth as it is moved across a shoe, for polishing a shoe. The rotation about axis 62 is also controllable and is much slower than the movement of the polishing fabric PF. The polishing machine may be provided with a computer control that amongst other things controls the speed of movement of the polishing fabric PF and the speed of rotation of the lens holder, the lens and the lap. The computer can also control the operation of drive link 96 for determining how long each region of the polishing fabric PF will be against the surface to be polished.

Referring to FIG. 18, the semi-finished lens L is shown which has a concave surface 10 to be polished and a convex opposite surface. A surface-saver (protective) tape 110 is provided on the back side of the lens L. An O-ring 112 is placed into an O-ring groove formed in a peripheral portion 114 of the lens holder 12 that is substantially at the mouth of a chamber 116. With the tape 110 attached, the lens L is moved towards the entrance of the chamber 116 and its edge 118 is moved against the O-ring 112 (FIGS. 15 and 16). Then, the lens L is pressed inwardly into the O-ring 112 which is made from a soft elastomeric material. Next, as shown in FIG. 17, an epoxy dispensing nozzle 120 is placed in opening 122. Next, an epoxy mix 124 is injected through the nozzle 120 into the cavity or chamber 116. Then, the epoxy 124 is allowed to harden. After hardening occurs, the lens L and the nozzle 120 are removed. A small diameter hole (e.g. 1 mm in diameter) is drilled through the epoxy body 122. This opening is designated 126 in FIGS. 1–7.

The lens holder 112 is now ready for use. It can be used repeatedly to mount lens L which have the same base curve and overall diameter as the first lens L.

FIG. 19 is a sectional view through the support ring 40 for the lap wall 42. FIG. 20 shows a fragment of the lap wall 42 which has been positioned in and connected to the ring 40. Preferably, ring 40 is constructed from a rigid polyvinyl chloride (PVC) provided with smooth finish surfaces. The wall material 42 is covered with a flexible clear sheet of polyvinyl chloride (PVC). The sheet 130 is bonded to the ring 40 by use of a vinyl solvent adhesive or a heat weld. The wall material 42 must be a material that has both a plastic state and a rigid state. By way of example, the material may be a natural pitch or a man-made equivalent substance that is normally hard but can be made soft and plastic by the addition of heat. A wall is formed from this material and then the wall is heated immediately before it is secured to the lap base 36, 38. The fluid pressure introduction into chamber 44 will move the softened material towards the lens curve 10. It will move until further movement is prevented by the lens surface 10. At that time, the surface of the lap wall that confronts the lens surface 10 has a curvature that matches the curvature of the surface 10 however it is a convex surface whereas in the example the surface 10 is a concave surface. While fluid pressure is maintained in the chamber 44, and the lap wall 42 is maintained in contact with the lens surface 10, but with the wear member 34 and the polishing fabric PF between them, the lap wall 42 is cooled or allowed to cool naturally so that it assumes its normal rigid form at ambient temperature. It is within the scope of the present invention to use a number of other materials that have both a plastic state and a rigid or solid state. One additional example is the lead cadmium alloy that is disclosed in the aforementioned U.S. Pat. No. 5,593,340. Also, the lap wall material may be an epoxy material that is soft and plastic when placed in the support ring behind the fabric wall 130. Air pressure is introduced into the chamber 44 while the epoxy wall 42 is still in a plastic state. Then the fluid pressure is increased to move the lap wall 42 against the lens surface 10, in the manner previously described. The fluid pressure is maintained until the epoxy has set up and is rigid.

In use, a lens having a surface to be polished is inserted into the lens holder 12 and the opening 126 is connected to a source of vacuum. The vacuum acts on the lens L and holds it in front of the epoxy body 124, with the lens edge 118 pressed against the O-ring 112. A lap wall assembly 40, 42 is brought to the lap base 36, 38 with the lap wall 42 in a plastic state. The support ring 40 is secured to the base wall 38 in the manner that has been described. Then, fluid pressure is introduced into chamber 44 and used to move the lap wall 42 up into a shape that conforms to the shape of the lens surface 10. At this time, the wear member 34 is in place and the polishing fabric PF is positioned over the lap wall 42, between the wear member 34 and the lens surface 10. Then, the lens holder 12 and the lens L and the lap 32 are held in a fixed position relative to each other while the polishing fabric PF is caused to move relative to both of them, with the polishing fabric PF moving across the lens surface 10. This can be done by holding the lens holder 12 and the lens L and the lap 32 in fixed positions, while rocking the drum 88, in the manner described, to move the polishing fabric PF across the lens surface 10. And, at the same time, the lens holder 12, the lens L and the lap 32 can be rotated together about axis 62, in the manner described above.

An advantageous feature of the holder 12 is that the vacuum will provide a definite connection of the article with the surface to be polished on the holder while at the same time allowing for a quick and easily removal of the article from the holder. In the case of a lens, the vacuum will not warp or bend the lens because of the presence of the epoxy backing. Once the epoxy backing is installed, the holder can be used over and over again with articles of the same size and top surface curvature.

The present invention permits the formation of a lap surface by use of a prescription surface on the lens or other member that is accurately cut but must be polished before it is finished. The air pressure in the chamber 44 below the lap wall 42 can be adjusted for the purpose of providing the exact amount of pressure needed on the polishing fabric PF so as to keep it into contact with the surface to be polished. After a lap has been created, it can be used over and over again to polish duplicate copies of the initial article on which the lap surface is based. Also, at times, a given lap can be used for changing the curvature of an article. For example, a lens blank may be furnished that has a surface that needs to be cut some as well as polished. The lap can be used to press the polishing fabric PF, equipped with coarse particles, against the surface and the polishing fabric PF can be moved across the surface until the surface is in a shape conforming to the shape of the lap. In other words, the present invention includes both conforming a lap surface to a surface to be polished and working a surface to be polished until it conforms to a lap surface.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A polisher for a surface on a member, comprising:

a support for a member having a surface that is to be polished;

a lap including a lap wall confronting the support;

said lap wall and said surface to be polished being fixed in rotational position relative to each other and both being rotatable together about a common axis; and a polishing fabric between the surface to be polished and the lap wall, said polishing fabric being slidable in position for polishing the surface to be polished, whereby the polishing fabric can be inserted between the surface to be polished and the lap wall and the polishing fabric can be moved across the surface to be polished, so as to cause the polishing fabric to polish the surface while being backed up and guided by the lap wall.

2. The polisher of claim 1, wherein the support is a vacuum lens holder and the surface to be polished is a surface on a lens that is held by vacuum on the support.

3. The polisher of claim 1, wherein the polishing fabric is flexible and elastic.

4. The polisher of claim 1, comprising a support and guide frame for the polishing fabric that is positioned on the side of the polishing fabric opposite the surface to be polished.

5. The polisher of claim 1, wherein the surface to be polished and the lap have different starting curvatures and the curvature of the lap is relatively fixed, whereby its movement of the polishing fabric against the surface to be polished will cause the surface to be polished to take on the curvature of the lap.

6. A polisher for a surface on a member, comprising:

a support for a member having a surface that is to be polished;

a lap including a lap wall confronting the support;

said lap wall and said surface to be polished being fixed in rotational position relative to each other;

a polishing fabric between the surface to be polished and the lap wall, said polishing fabric being slidable in position for polishing the surface to be polished, whereby the polishing fabric can be inserted between the surface to be polished and the lap wall and the polishing fabric can be moved across the surface to be polished, so as to cause the polishing fabric to polish the surface while being backed up and guided by the lap wall; and wherein the lap wall has a peripheral edge, a rigid mounting ring surrounds the peripheral edge, and the peripheral edge is secured to the mounting ring.

7. A polisher for a surface on a member, comprising:

a support for a member having a surface that is to be polished;

a lap including a lap wall confronting the support;

said lap wall and said surface to be polished being fixed in rotational position relative to each other;

a polishing fabric between the surface to be polished and the lap wall, said polishing fabric being slidable in position for polishing the surface to be polished, whereby the polishing fabric can be inserted between the surface to be polished and the lap wall and the polishing fabric can be moved across the surface to be polished, so as to cause the polishing fabric to polish the surface while being backed up and guided by the lap wall; and said polisher further comprising a support and guide frame for the polishing fabric that is positioned on the side of the polishing fabric opposite the surface to be polished, and a lap support that is movable axially relative to the support and guide frame for the polishing fabric.

8. The polisher of claim 7, wherein the lap support, the lap, and the support and guide frame for the polishing fabric are rotatable together about a common axis.

9. The polisher of claim 7, wherein the lap support, the lap, the support and guide ring for the polishing fabric, and the support for the member with a surface to be polished, are all movable together relative to the polishing fabric.

10. The polisher of claim 9, including a polishing fabric drive, the polishing fabric is connected to the drive, and the drive oscillates and moves the polishing fabric first in one direction along the surface to be polished and then in the opposite direction along the surface to be polished.

11. A polisher for a surface on a member, comprising:

a support for a member having a surface that is to be polished;

a lap including a lap wall confronting the support;

said lap wall and said surface to be polished being fixed in rotational position relative to each other;

a polishing fabric between the surface to be polished and the lap wall, said polishing fabric being slidable in position for polishing the surface to be polished, whereby the polishing fabric can be inserted between the surface to be polished and the lap wall and the polishing fabric can be moved across the surface to be polished, so as to cause the polishing fabric to polish the surface while being backed up and guided by the lap wall; and said polisher further comprising a support and guide frame for the polishing fabric that is positioned on the side of the polishing fabric that is opposite the surface to be polished, and a rigid mounting ring surrounding the lap wall, said lap wall having a peripheral edge that is secured to the mounting ring.

12. The polisher of claim 11, further comprising a lap support that is movable axially relative to the support and guide frame for the polishing fabric.

13. The polisher of claim 12, wherein the lap support, the lap, the support and guide frame for the polishing fabric and are movable together.

14. The polisher of claim 12, wherein the lap support, the lap, the support and guide frame for the polishing fabric, the support for the member with a surface to be polished, are all movable together relative to the polishing fabric.

15. The polisher of claim 14, including a polishing fabric drive, the polishing fabric is connected to the drive and the drive that oscillates and moves the polishing fabric first in one direction along the surface to be polished and then in the opposite direction along the surface to be polished.

16. A polisher for a surface on a member, comprising:

a support for a member having a surface that is to be polished;

a lap including a lap wall confronting the support;

said lap wall and said surface to be polished being fixed in rotational position relative to each other;

a polishing fabric between the surface to be polished and the lap wall, said polishing fabric being slidable in position for polishing the surface to be polished, whereby the polishing fabric can be inserted between the surface to be polished and the lap wall and the polishing fabric can be moved across the surface to be polished, so as to cause the polishing fabric to polish the surface while being backed up and guided by the lap wall; and said polisher further comprising a frame, a first linear actuator on the frame mounting the support for the member having a surface that is to be polished for movement back and forth along an axis, and a second linear actuator for moving the lap back and forth along the same axis.

17. The polisher of claim 16, wherein the first and second linear actuators are laterally offset.

18. The polisher of claim 17, further comprising a support and guide frame for the polishing fabric that is positioned axially between the support for the member having a surface to be polished and the lap.

19. The polisher of claim 18, comprising a turntable to which both linear actuators are connected, said turntable being mounted for rotation about the longitudinal axis of the holder and lap.

20. The polisher of claim 19, wherein the first linear actuator is a linear fluid motor having a fixed first portion connected to the turntable and a movable second portion movable axially relative to the first portion, said second portion including the support for the member having a surface to be polished.

21. The polisher of claim 20, wherein the second linear actuator is a linear fluid motor having a first portion that is connected to the turntable and a movable portion that extends and retracts relative to the first portion, and the lap is connected to the second portion.

22. The polisher of claim 21, wherein the turntable is connected to rotate about the lap axis.

23. The polisher of claim 22, further comprising a support and guide frame for the polishing fabric that is connected to rotate with the lap.

24. A polisher for a surface on a member, comprising:

a support for a member having a surface that is to be polished;

a lap including a lap wall confronting the support;

said lap wall and said surface to be polished being fixed in rotational position relative to each other;

a polishing fabric between the surface to be polished and the lap wall, said polishing fabric being slidable in position for polishing the surface to be polished, whereby the polishing fabric can be inserted between the surface to be polished and the lap wall and the polishing fabric can be moved across the surface to be polished, so as to cause the polishing fabric to polish the surface while being backed up and guided by the lap wall; and wherein said lap wall comprises a material that has a first state in which it can be moved against the surface to be polished, and when-so moved will assume the shape of the surface to be polished, and a second state in which it is solid and conforms to the shape of the surface to be polished.

25. A method of polishing a surface on a member, comprising:

mounting a member having a surface to be polished onto a support with the surface to be polished directed away from the support;

confronting the surface to be polished with a lap;

positioning a polishing fabric between the surface to be polished and the lap wall;

moving the lap wall and the polishing fabric relatively towards and against the surface to be polished;

moving the polishing fabric relatively over the surface to be polished while it is backed up and pressed against that surface by the lap wall; and moving the support and the member having a surface to be polished and the lap wall sideways together, so as to move the surface to be polished relatively across the polishing fabric.

26. The method of claim 25, wherein the member having a surface to be polished is an optical lens.

27. The method of claim 25, comprising further moving the polishing fabric back and forth along the surface to be polished.

28. A method of polishing a surface on a member, comprising:

mounting a member having a surface to be polished onto a support with the surface to be polished directed away from the support;

confronting the surface to be polished with a lap;

positioning a polishing fabric between the surface to be polished and the lap wall;

moving the lap wall and the polishing fabric relatively towards and against the surface to be polished;

moving the polishing fabric relatively over the surface to be polished while it is backed up and pressed against that surface by the lap wall;

providing a lap wall that is constructed from a material that has a plastic state and a solid state;

moving the lap wall and polishing fabric towards the surface to be polished while the lap wall is in its fluid state, so that the polishing fabric will be moved against the surface to be polished and the lap wall will be behind it and will conform to the shape of the surface to be polished;

causing the shaped lap wall material to assume a solid state; and moving the polishing fabric relatively over the surface to be polished while it is backed up and pressed against that surface by the lap wall.

29. A method of polishing a surface on a member, comprising:

mounting a member having a circular surface to be polished onto a support with the surface to be polished directed away from the support;

confronting the surface to be polished with a circular lap wall;

positioning a polishing fabric between the surface to be polished and the lap wall;

moving the lap wall and the polishing fabric relatively towards and against the surface to be polished; and moving the polishing fabric relatively against the surface to be polished while it is backed up and pressed against that surface by the lap wall.

30. The method of claim 29, wherein the member having a surface to be polished is an optical lens.

31. The method of claim 29, comprising positioning a support and guide frame for the polishing fabric about the lap wall; and positioning the polishing fabric on the support and guide frame, with a portion of it positioned between the surface to be polished and the lap wall.

32. The method of claim 31, wherein the member having a surface to be polished is an optical lens.

33. The method of claim 31, comprising moving the polishing fabric back and forth across the surface to be polished.

34. The method of claim 33, wherein the member having a surface to be polished is an optical lens.

* * * * *